United States Patent [19]

Coleman

[11] 4,186,868

[45] Feb. 5, 1980

[54] SPECIALTY ENVELOPE

[76] Inventor: John D. Coleman, 26 A Great Woods Ct., Fairport, N.Y. 14450

[21] Appl. No.: 901,502

[22] Filed: May 1, 1978

[51] Int. Cl.[2] ..... B65D 27/14

[52] U.S. Cl. ..... 229/92.1; 40/156; 206/492; 229/92.7

[58] Field of Search ..... 206/460, 492; 229/92.7, 229/92.8, 80, 92.1; 40/156

[56] References Cited

U.S. PATENT DOCUMENTS

| | | | |
|---|---|---|---|
| 1,720,721 | 7/1929 | Culotta | 229/92.7 |
| 2,316,757 | 4/1943 | Berkowitz | 229/92.7 |
| 2,601,530 | 6/1952 | Kegan et al. | 229/92.7 |
| 3,458,034 | 7/1969 | Larson | 229/92.8 |

*Primary Examiner*—Stephen P. Garbe

*Attorney, Agent, or Firm*—Jones, Thomas & Askew

[57] ABSTRACT

An envelope for sending a written message with a photograph attached thereto. An adhesive is provided on one flap for attaching a photograph; the flap can then be folded so that the photograph is over the writing surface. Other flaps fold over the photograph so that the photograph is shielded in its entirety.

2 Claims, 4 Drawing Figures

SPECIALTY ENVELOPE

BACKGROUND OF THE INVENTION

Since the invention of inexpensive cameras, it has become common for people to provide photographs to accompany and illustrate letters mailed to relatives and friends. More recently, custom made postcards and Christmas cards wherein the front of the card comprises a photograph have been available. The most salient disadvantage of such custom postcards is that the photograph is often damaged during the passage of such postcards through the mails.

When photographs are simply included in a conventional envelope along with a letter, they may become separated from the written message and misplaced when the envelope is opened by the recipient.

The prior art discloses envelopes of unitary construction wherein part of the surface is used to contain the written message and part for the address. These envelopes have been designed for use in applications where minimization of weight of each piece of mail is important, such as airmail or overseas mailings, but have not provided any special means for unitarily attaching a photograph or the like to the written message.

SUMMARY OF THE INVENTION

The present invention comprises a specialty envelope which has a writing surface, two side flaps, a rear flap at one end of the writing surface, and a relatively short front flap at the other end of the writing surface having an adhesive strip thereon for application to the back of a photograph or similar object. The photograph and the short front flap may be folded over the writing surface once the message is written. The side flaps are disposed so that they may be folded over the back of the photograph. In one embodiment of the invention, the side flaps are cut so that the sum of their widths is substantially equal to the width of the writing surface and will therefore cover substantially all of the back of the photograph when folded thereover. The back flap is provided with an adhesive strip near its distal end so that when it is folded over the previously folded side flaps, its adhesive surface will be in communication with the lower side of the front flap.

It is an object of the present invention to provide a specialty envelope which will completely protect a photograph or similar object during passage through the mail.

It is a further object of this invention to provide a convenient means of attaching a photograph or the like to a written message so that message and photograph do not become separated when opened by the recipient.

It is a further object of this invention to provide an envelope for transmitting a written message and a photograph so that the recipient is presented with an attractive and unitary display of photograph and message upon opening.

These and other objects of the present invention will become apparent from the following description of the preferred embodiment.

DESCRIPTION OF THE PREFERRED EMBODIMENT

Figures 1, 2, 3, 4:
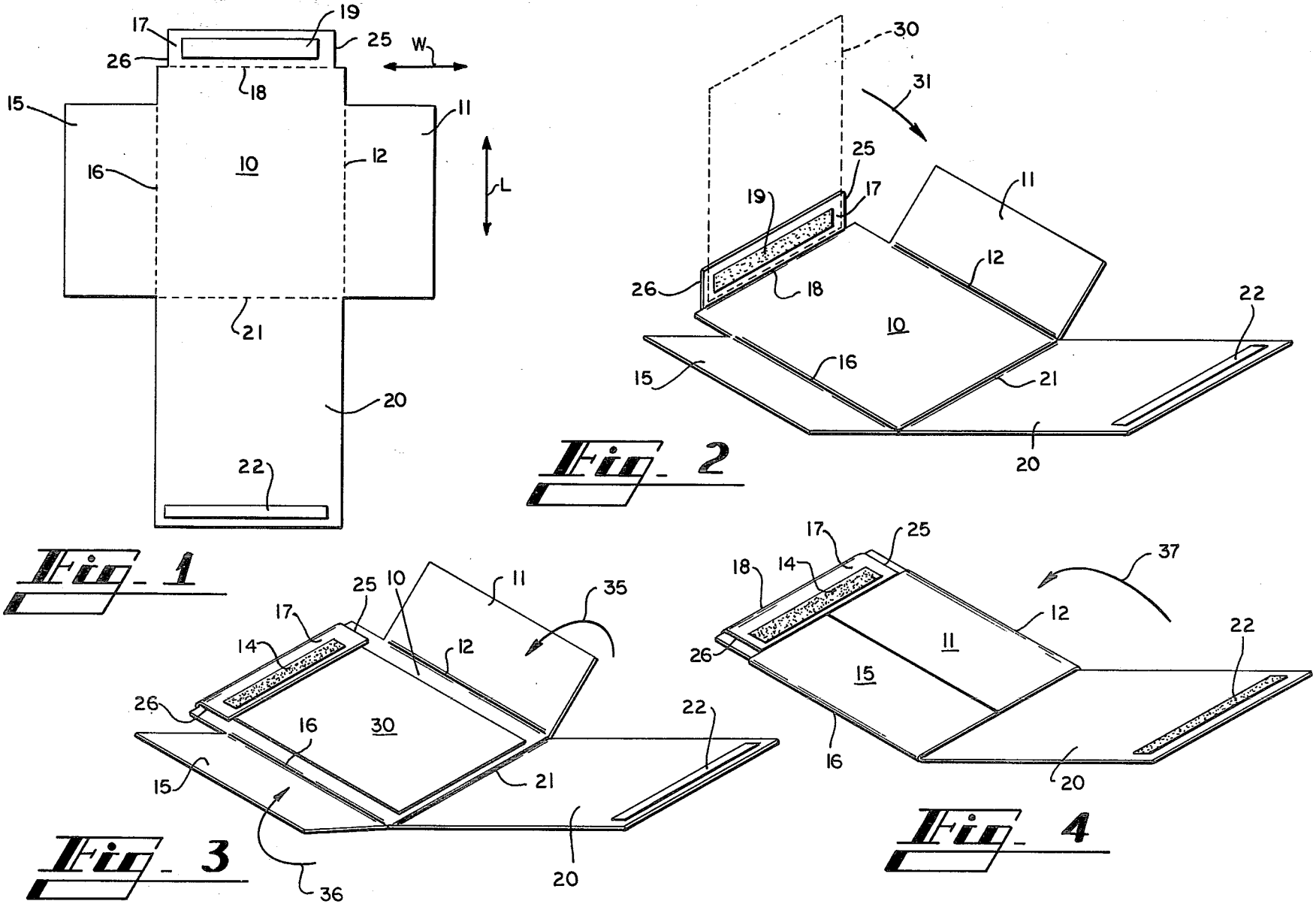
FIG. 1 is a plan view of the preferred embodiment of the present invention.
FIG. 2 is a pictorial view of the preferred embodiment.
FIG. 3 is a pictorial view of the preferred embodiment shown with the front flap and a photograph folded over the writing surface.
FIG. 4 is a pictorial view of the preferred embodiment shown with the front flat and side flaps folded over the writing surface.

Turning first to FIG. 1 wherein a plan view of the preferred embodiment of the present invention is shown, it can be seen that this embodiment is an envelope comprising a writing surface 10, a right side flap 11 which may be folded over writing surface 10 along crease 12, a left side flap 15 which may be folded over writing surface 10 along crease 16, a front flap 17 having adhesive strip 19 thereon which may be folded over writing surface 10 along crease 18, and a rear flap 20 which has an adhesive strip 22 thereon which may be folded over writing surface 10 along crease 21.

In the terminology throughout this application, width dimensions of the present invention will be referred to as being parallel to line W shown in FIG. 1 and length dimensions will be referred to as dimensions parallel to line L in FIG. 1. Furthermore the upper surface of any particular component of the specialty envelope of the present invention is considered to be that surface visible in the plan view of FIG. 1 wherein it is understood that writing surface 10 is the surface provided for recording of a written message and which will be covered by flaps 11, 15, 17 and 20 when the specialty envelope is prepared for deposit in the mail.

In the preferred embodiment shown in FIG. 1, right side flap 11 and left side flap 15 are each of a width approximately one-half that of writing surface 10. This is so that flaps 11 and 15 will cover substantially all of writing surface 10 when they are folded thereover. For the same reason, rear flap 20 is of substantially the same area as writing surface 10.

In the preferred embodiment shown in FIG. 1, front flap 17 is three and one-half inches wide and writing surface 10 is four inches wide. The preferred embodiment was so designed that when a standard snapshot photograph with a three and one-half inch width is attached to front flap 17, the edges of the photograph will be co-linear with edges 25 and 26 of front flap 17. Similarly when a standard print from a 35 mm camera having a four inch width is attached to front flap 17, the edges of the photograph will be co-linear with creases 12 and 16 forming boundaries of writing surface 10. It will be understood by those skilled in the art that these dimensions are only those of the preferred embodiment have been chosen for the reasons explained above and should not be considered to limit the scope of the present invention.

Adhesive surfaces 19 and 22 as shown in FIG. 1 are implemented by conventional two-sided adhesive tape in the preferred embodiment. Thus for adhesive surface 19, one adhesive side is applied to front flap 17 while a peel-off protective cover remains over adhesive surface 19 until the envelope is ready for use. Adhesive surface 22 on rear flap 20 is of similar material. The lower surface of front flap 17 also contains an adhesive strip 14 which may be seen in FIGS. 3 and 4. In the preferred embodiment this adhesive strip is implemented by the same type of two sided adhesive tape described hereinabove for adhesive surfaces 19 and 22.

The preferred embodiment shown in FIG. 1 is of a unitary construction, and thus may be die cut from a single sheet of material with creases 12, 16, 18 and 21 being formed by folding along appropriate lines.

The operation and use of the present invention will now be explained. The user of the present invention will write a written message on writing surface 10. It is assumed that the user desires to provide a photograph to accompany the written message. As previously explained, adhesive strip 19 on front flap 17 is a two-sided adhesive tape in the preferred embodiment and once the user has written a message on writing surface 10, he would then peel a protective coating from the exposed side of the tape so that adhesive surface 19 would have a sticky, tacky surface ready to adhere to some foreign object.

Turning to FIG. 2, the placement of a photograph 30, is shown as a phantom in FIG. 2. Adhesive strip 19 is applied to the back side of photograph 30 so that, as shown in FIG. 2, the recipient will be able to read the message and observe the photograph at the same time.

With the photograph thus in place, front flap 17 and photograph 30 are folded inwardly toward writing surface 10 in a direction shown by arrow 31 in FIG. 2.

The envelope will then be in a configuration as shown in FIG. 3 in the drawings and the user would then fold flaps 11 and 15 in directions shown by arrows 35 and 36, respectively, so that the envelope is then in a configuration as shown in FIG. 4.

To complete closure of the specialty envelope, the protective strip from adhesive strip 22 is first peeled off thus preparing adhesive strip 22 to stick to any surface with which it comes in contact. Next, the protective strip is peeled from adhesive strip 14 likewise preparing strip 14 to stick to any surface with which it comes in contact. Then rear flap 20 is folded toward front flap 17 in a direction indicated by arrow 37 in FIG. 4. As can be seen from examination of FIG. 4, adhesive strip 22 will contact adhesive strip 14 on the lower side of front flap 17 when rear flap 20 is so folded and thus seal the specialty envelope securely with the photograph well protected inside.

The recipient of the message and photograph on the specialty envelope of the present invention will open it essentially by reversing the steps shown in FIGS. 2–4. Thus when the recipient has opened the received specialty envelope, he will be presented with the message on writing surface 10, and photograph 30 securely attached to the message as shown in FIG. 2.

It will be understood by those skilled in the art that the foregoing description of the preferred embodiment is an example of the present invention and that other embodiments which provide the unique features of simultaneous visibility of photograph and written message, the secure attachment of the photograph to the written message, and complete protection for a photograph during passage through the mails are possible. Therefore the scope of the present invention should be limited only by the claims appended hereto.

What is claimed is:

1. An envelope assembly comprising a writing surface having a first length, a right side flap disposed so that said right side flap may be folded to cover a portion of said writing surface;

a left side flap disposed so that said left side flap may be folded to cover a portion of said writing surface;

a front flap having a second length, having a lower surface, and having a front flap upper surface with a first adhesive means disposed thereon for fastening a foreign object to said front flap;

a rear flap having a third length and having a rear flap upper surface;

said third length being substantially the same as said first length;

said rear flap being disposed so that it may be folded to cover a portion of said writing surface;

second adhesive means disposed on said front flap lower surface for attaching said rear flap upper surface to said lower surface when said rear flap is folded over said writing surface subsequent to said front flap being folded over said writing surface; and wherein the sum of second second length and said third length is greater than said first length.

2. The envelope assembly of claim 1 further comprising:

third adhesive means disposed on said rear flap upper surface for engaging said second adhesive means when said rear flap is folded over said writing surface subsequent to said front flap being folded over said writing surface.

* * * * *